United States Patent [19]

Wolter

[11] 4,376,383

[45] Mar. 15, 1983

[54] COUPLING MEMBER FOR THE SUSPENSION OF A KEY RING

[76] Inventor: Heinz Wolter, Meiswinkel 3, 5067 Kürten, Fed. Rep. of Germany

[21] Appl. No.: 244,187

[22] Filed: Mar. 16, 1981

[30] Foreign Application Priority Data

Apr. 1, 1980 [DE] Fed. Rep. of Germany ..... 3012607

[51] Int. Cl.[3] ..... A47G 29/10

[52] U.S. Cl. ..... 70/456 R; 70/459

[58] Field of Search ..... 70/456 R, 459, 456 B, 70/457–458; 24/233, 234, 235, 236, 248 E, 252

[56] References Cited

U.S. PATENT DOCUMENTS 2,708,073 5/1955 Mohylowski ..... 70/456 R
3,545,049 12/1970 Brueggeman ..... 24/236
3,952,382 4/1976 Vaage ..... 24/234
3,956,804 5/1976 Gotof ..... 24/235

FOREIGN PATENT DOCUMENTS 1448259 6/1966 France ..... 70/459
614224 12/1960 Italy ..... 70/459

*Primary Examiner*—Robert L. Wolfe
*Attorney, Agent, or Firm*—Martin A. Farber

[57] ABSTRACT

A coupling member for attachment of a key ring provided with an eye arranged in the vicinity of one end for the attachment of a key ring and having at the opposite end a mouth which can be opened by one-hand operation against spring biasing. The mouth is formed by jaws which come together in tong-like manner and which have an opening cross section. The latter, the interior inner space of the mouth and the eye are arranged one in back of the other on a longitudinal axis of the coupling member.

10 Claims, 16 Drawing Figures

COUPLING MEMBER FOR THE SUSPENSION OF A KEY RING

The present invention relates to a coupling member for the suspension of a key ring which in the region of its one end has an eye or the like for the attachment of the key ring and at its other end has a mouth which can be opened against spring biasing by a one-handed operation.

The holding of keys together by means of a narrowly coiled key ring of spring steel proves disadvantageous always in cases in which a key is to be removed, for instance for a brief time, from the bunch. This is time-consuming and difficult to effect under unfavorable light conditions and is therefore not done whenever possible. Referred to an everyday example from actual practice this would mean, for instance, in the case of a bunch of automobile keys that one must pull the ignition key out in order to be able to use the garage key which is present on the same ring. On the other hand, there are also devices such as spring hooks, openable attachment rings, etc., which when associated with the key ring can be used as a coupling member. This, however, also constitutes merely a makeshift solution and does not attack the actual problem.

The object of the present invention is, therefore, to develop a coupling member of the above-described type which is simple to manufacture and favorable in use and permits a rapid and easy removal of one or more keys from the key ring, but a removal which can only be effected intentionally, so that the key function of the inserted key need not be interrupted; furthermore, the attached condition should be capable of being brought about in dependable fashion easily and at any time.

This object is achieved in that both of the tong jaws (2), which jaws are mounted on a common pivot axle (11) of the middle piece (1), can be displaced against their spring-biasing in the opening direction by actuating surfaces (10, 10', 18) which are depressible transversely to the longitudinal axis (x—x) of the middle piece and lie between the eye (Ö) and the mouth (M).

As a result of its formation, a coupling member which is extremely easy to handle is obtained. The key need no longer be separated from the remaining bunch of keys by cumbersome "threading off" from the key ring. On the other hand, as compared with the use of an ordinary spring clip, the lateral hooking and unhooking, which is difficult particularly in the dark, is done away with. The functional parts lie rather in meaningful sequence one behind the other. This specifically facilitates the desired coordinating or disconnecting of an inserted key. The mouth which grasps this key is in this connection advantageously formed of jaws which move against each other in the manner of tongs. Adjoining the opening cross section of the mouth there is present, in lengthwise direction, the inside of the mouth, whereupon the coupling member is terminated on the same longitudinal axis by the eye into which the key ring thread, said key ring containing the remaining keys. Such a coupling member also rests conveniently in the hand, as a result of which, as a whole, the gripping surface is further increased by the remaining keys. Thus an optimum shape is obtained, also with consideration of the ergonometric conditions. In this connection it furthermore proves advantageous that the longitudinal axis forms the axis of symmetry. There is no lateral projection which differs in its position in space; rather there are completely identical operating conditions regardless of whether the coupling member lies in the palm of one's hand on its back or its front surface and therefore on one or the other wide side. Instead of direct actuation via the outer narrow edges of the actuating levers, indirect release can be effected; the corresponding mechanism, with maximum convenience in operation, then has a form in which the tong jaws each developed as a single arm can be actuated by a push piece which is movable transversely to the plane of movement of the tong jaws and is mounted in a guide shaft for same. The actuating surface of the corresponding push piece has approximately the area of the tip of a finger. The tong-jaw return spring at the same time biases the push piece outwardly. A convenient release actuation results if two push pieces which are open, i.e. accessible, on the two wide sides of the middle piece are actuatable in opposite directions to each other. A structurally simple as well as extremely trouble-free development is obtained if the push pieces are conical on their inner sides and press against the edge of control edges, for instance holes, in the actuating arms of the tong jaws, which arms are broadened somewhat for this purpose. In this connection it is favorable for the return springs of the tong jaws to lie in the plane of movement of the latter and for the springs to be arranged in the region of the actuating arms laterally of the holes. The coupling member advantageously also carries a source of light. In this way an advantageous double function is imparted to the push piece. The corresponding easy to assemble construction concretely is made such that the push piece receives within it a button battery, the edge of which, as a result of a recess in the cup wall extending beyond the depth of penetration of the push piece strikes in depressed position against one terminal of a bulb which is arranged in the direction of and lies in the plane of movement of the tong jaws and is aligned with the opening cross section of the mouth.

The push piece is accordingly also a light switch. An embodiment which leads to a compact, i.e. extremely flat shape of the coupling piece and in which the bulb can lie even in the plane of movement of the tong arms, comprises forming the tong-jaw return spring as a U-shaped spring, the arms of which surround the pivot-side end and actuating ends of the tong jaws are both partially stepped down in the region of their resting point. A construction which in particular is of simple assembly is obtained in the manner that the cup-shaped push piece which contains the button battery in a friction fit forms, on opposite sections of its outer cup wall, control surfaces against which rest the tong-jaw actuating arms which are spring biased into the closing direction and that the cup edge has snap-in clip projections which engage behind the edge of the guide shaft and limit the outward movement of the push piece caused by the actuating arms of the tong jaws.

Special means to secure the button battery in the push piece can therefore be dispensed with. The push piece can rather be conveniently equipped in advance with the battery and it need still merely be associated simply with the push piece by means of the clip or snap-in connection. The spring-biased actuating arms which act on the corresponding control surfaces of the push piece effect in reliable manner the outward movement of the push piece into its normal position. Disassembly is also easy to effect, in the manner that the cup wall is formed with the recess which extends over the wide side of the middle piece for attachment of a tool which disengages the push piece from the guide shaft. As a result, the changing of batteries is extremely simple and can be carried out practically by anyone.

A flattening on the ends of the tong jaws provided on the inside in the region of the mouth opening which has the shape of a linearly extending keyhole resting edge avoids a spreading apart of the mouth even in case of above-average pulling forces on the middle piece, for instance as a result of a disproportionately heavy bunch of keys or the like. Any tendency towards coming loose by itself is avoided. Another advantageous safety feature is that the end sections of the jaws can overlap over each other with the formation of a Z-joint. In this case there is obtained a practically claw-type closure of the mouth which protects the point of articulation of the actuating arms.

Further advantages and details of the subject matter of the invention will be described below on basis of various and preferred embodiments shown diagrammatically in FIGS. 1 to 16, in which.

The coupling member is accordance with all the embodiments has an elongated middle piece 1 which forms the actual basic body. Its longitudinal axis is designated x—x.

The middle piece 1 supports at most two jaws 2 which come in tong-like manner against each other. The jaws are located at the top end of the middle piece 1. The tong jaws 2 form a mouth M which can only be opened intentionally and the width or cross section of opening of which is designated y.

Adjacent this opening cross section y is the inside R of the mouth M. The coupling member 1 as such terminates, proceeding in the same lengthwise direction, with an eye Ö; opening cross section y, interior space R and eye Ö accordingly lie on one and the same longitudinal axis x—x. This longitudinal axis x—x at the same time represents the axis of symmetry of the coupling member.

Figure 10:
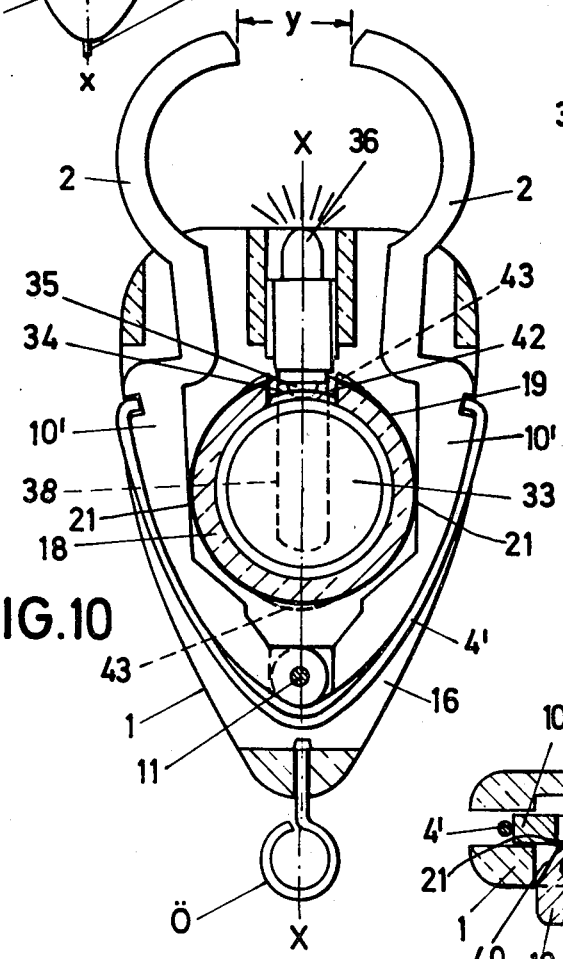
FIG. 10 is a section along the line X—X of FIG. 9, but with the mouth open.

The mouth is held closed under spring biasing. The return spring (FIG. 10) or springs which act to close the tong jaws 2 are designated 4' or respectively 4. The jaw end surfaces 2' (FIG. 7) abut in a butt joint against each other. The end surfaces also lie in the longitudinal axis x—x in the closed position of the coupling member. The end surfaces can, however, diverge outwardly by approximately half the jaw thickness at an angle of about 45° so that they form guide surfaces which assist in the opening of the mouth.

The jaw ends pass through the hole 5 in the end 6 of, for instance, an ignition key 7. The eye Ö which lies at the other end carries in articulated manner a key ring 8 on which additional keys 9, such as for instance also a garage key, are placed.

These remaining keys can be disconnected from the ignition key 7 so that the ignition key remains in the ignition and the motor therefore need not be started again. This disconnecting can only be effected intentionally but nevertheless it can be done in very convenient manner. The opening movement of the tong jaws is brought about indirectly or directly by one-hand operation against the force of the return springs 4. Such a direct actuation can be noted from the embodiment of FIGS. 1 to 4 where the hand of the operator acts directly on the structural parts forming the tong jaws 2.

Each of the two tong jaws 2 continuously extend, in one-piece into the form of an actuating lever 10. The actuating levers are mounted on the middle piece 1. Their common pivot pin is designated 11. The tong jaws 2 are relatively narrow while the actuating lever 10, which continues into the pivot region, protrudes freely over a part of its surface and can be actuated on its free narrow edges, passes into a widened portion. The structural parts which form the tong jaws 2 are S-shaped stampings. Their ends change, crossing each other, over the longitudinal axis x—x. The middle piece 1 has the shape of an oval with different end radii. The thicker end is located on the side of the mouth M.

The return springs 4 act from the inside against the actuating levers 10 in the embodiment shown in FIGS. 1 to 17. The return springs 4, which are developed here as coil compression springs, are each arranged in a transverse bore 13, developed as a blind hole, in the middle piece 1.

The stampings are inserted into slot-like shafts 16 of the middle piece 1, which forms practically a housing. The shafts take into consideration the scissor-like superimposition of the stampings, which, however, are bent off into a common plane in the region of the mouth (see FIG. 2). The contour of the shafts 16 forms stop edges 17 for the opening movement.

Figure 1:
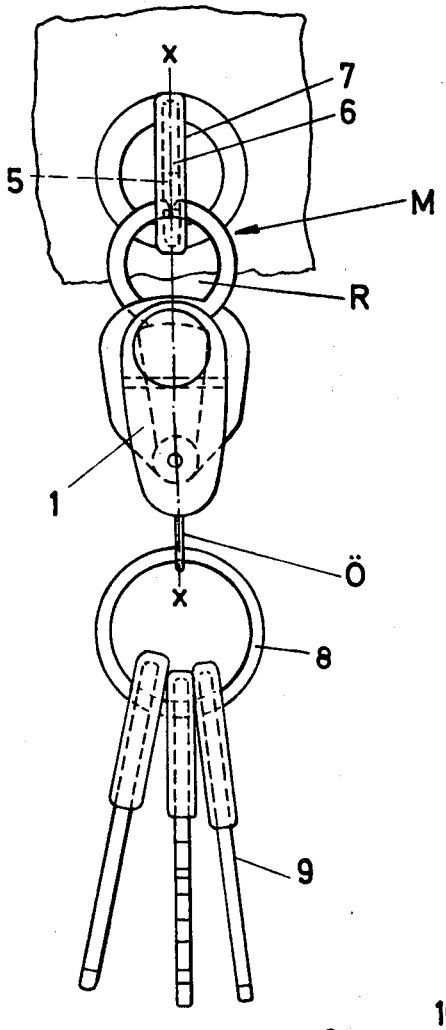
FIG. 1 shows the coupling member of the first embodiment with keys, seen in front view.
Figure 2:
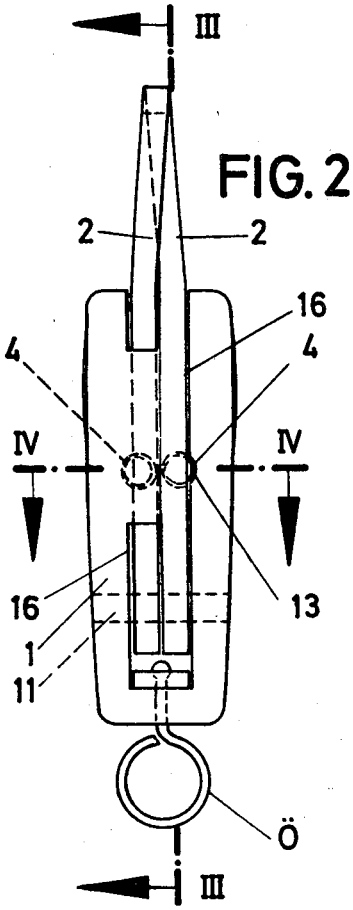
FIG. 2 is a side view thereof.
Figure 3:
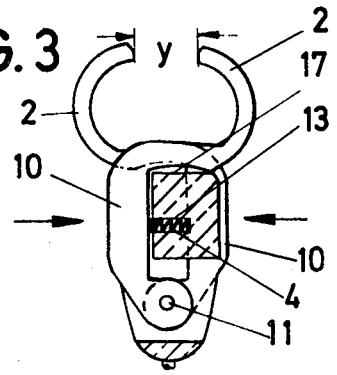
FIG. 3 is a section along the line III—III of FIG. 2, but with the mouth open.
Figure 4:
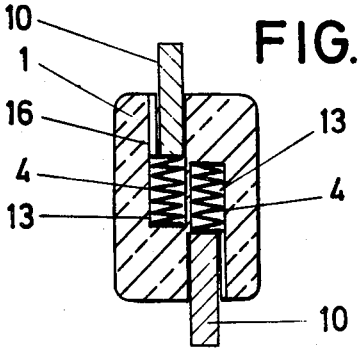
FIG. 4 is a section along the line IV—IV of FIG. 2.
Figure 5:
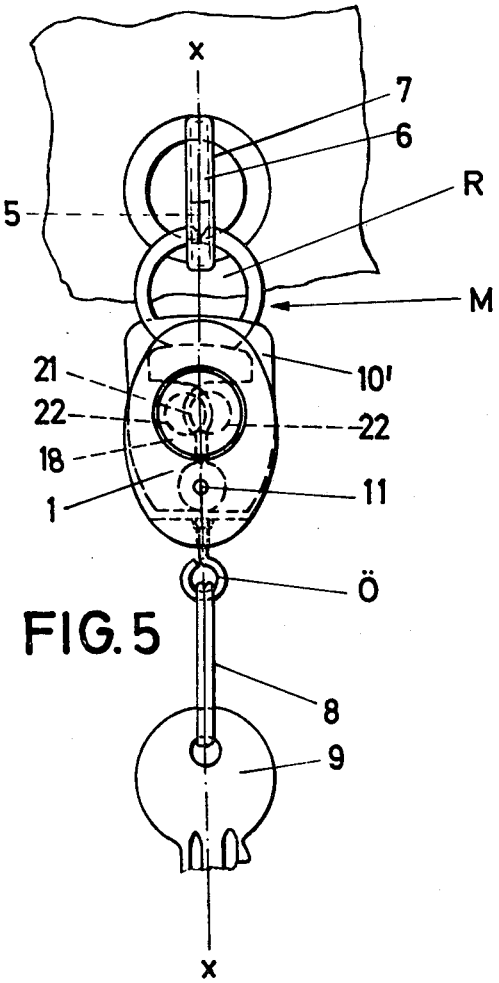
FIG. 5 shows the coupling member of the second embodiment, in front view.
Figure 6:
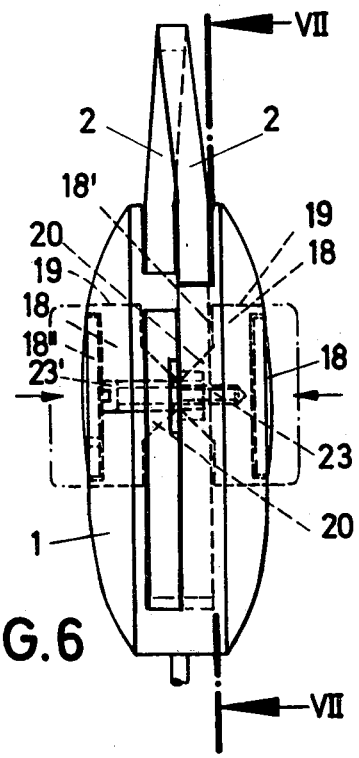
FIG. 6 is a corresponding side view.
Figure 7:
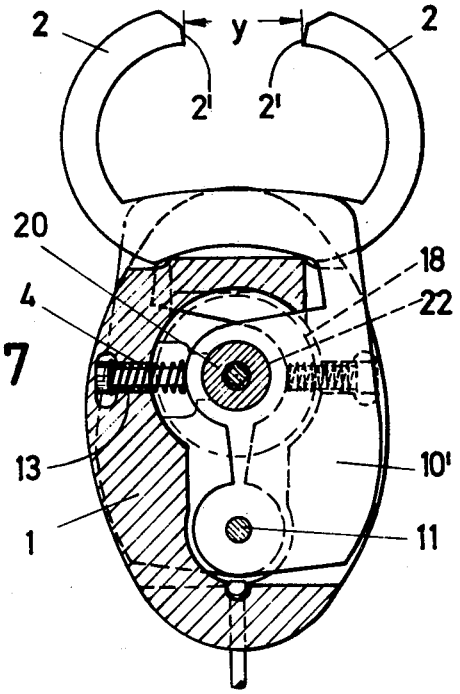
FIG. 7 is a section along the line VII—VII of FIG. 6, with the mouth open.
Figure 8:
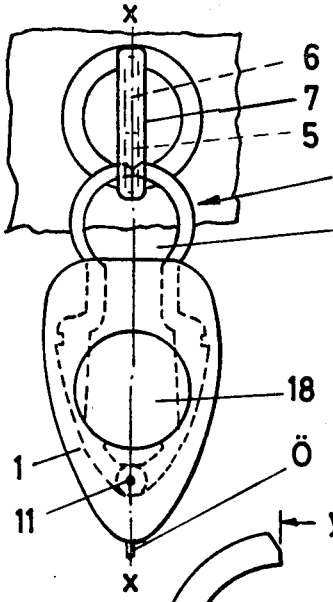
FIG. 8 shows the coupling member of the third embodiment, in front view.
Figure 9:
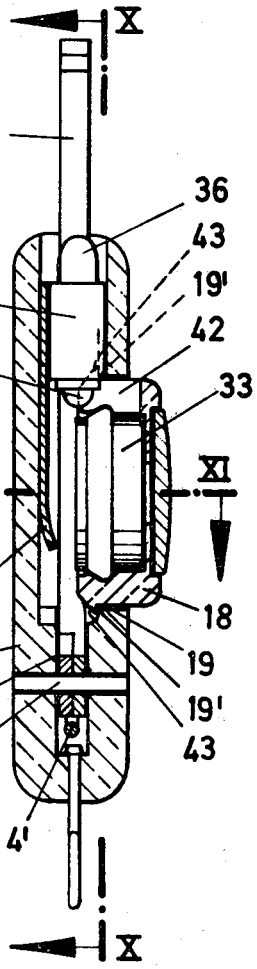
FIG. 9 shows this coupling member in an enlarged vertical section.

In the embodiment shown in FIGS. 5 to 7, the direct actuation of the tong jaws 2 is brought about by indirect actuation. For this purpose, each of the tong jaws 2 has a push piece 18 which is displaceable transversely to the plane of movement of the jaws. The guide shafts which receive the push pieces 18 are designated 19. They are open towards the wide sides of the relatively flat middle piece 1 so that one can, with one's finger, press the protruding push pieces 18 in the direction of actuation, i.e. against each other. The push pieces 18, which in this case are substantially disk-shaped, are also mounted in the longitudinal axis x—x of the middle piece 1 of oval contour.

Each of the push pieces 18 towards the inside has a portion forming a cone or conical frustum 20. The base surface thereof terminates in the same plane as the inner surface of the push piece 18. The surface of the conical frustum cooperates with a control edge 21 which is formed by the edge of a hole 22 formed in the actuating arm 10' of the tong jaws 2. As can be noted from FIG. 5, in the closed position the holes 22 come into such a position of overlap that only a reduced approximately lens-shaped hole cross-section is present. Only upon the depression of the push pieces 18 and the resultant penetration of the conical frustums 20 into the holes 22 are the latter forced into coinciding position with each other, which leads to the opening of the mouth M (see FIG. 7).

The connecting of the push pieces 18 to each other is effected by a centrally located threaded pin 23 protruding from the conical frustum and guided displaceably, limited by abutment, within the push piece extends from one push piece and enters into the corresponding internal thread of the opposite push piece 18. Its head 23' strikes in an outward direction, abutment limited, against a shoulder formed by the corresponding central hole of the one push piece 18. The pin 23 protrudes from the inside of said push piece 18 which is hollowed out on the outer side. The inside can be closed by a cover plate 18''. The stroke of the cone corresponds to the thickness of the two stampings. The stop shoulder is located approximately in the region of the tapered end of the conical frustum 20.

Each actuating arm 10' has a return spring 4 associated with it. The return springs 4 lie in the plane of movement of the tong jaws 2 and here also are mounted in the region to the side of the actuating arms.

The embodiment in accordance with FIGS. 8 to 11 constitutes a further development, insofar as the push piece 18 which is here of cup shape and is formed with an inwardly facing cup-shaped opening, receives a button battery 33 within it. Here, to be sure, only one push piece 18 is provided, it being so adapted however with respect to the control of the tong jaws 2 that the push piece controls both tong jaws and their actuating arms 10'. In the depressed position of the push piece 18, the rim 34 of the button battery 33 comes against one terminal 35 of a bulb 36 arranged in the middle piece 1. The bulb 36 protrudes at the top of the middle piece 1, and therefore in the direction towards the opening cross section y or tong mouth M. Upon the opening movement of the mouth the bulb is simultaneously connected. The target place is thereby illuminated, which additionally facilitates the coupling of the coupling member with the inserted key 7.

The bottom of the middle piece 1 is covered with a conductive strip 38 which closes the circuit and leads to the screw base 39 of the bulb 36. The strip 36 is raised somewhat at its end in the direction towards the push piece 18 so that a scale-removing function is obtained as a result of the rubbing contact thereby achieved.

The button battery 33 is held by a clamp fit in the cup-shaped push piece 18 and is thus secured in position. It can thus not fall into the free section of the guide shaft 19. The contact-making, correspondingly peripherally protruding rim 34 of the button battery 33 can advantageously be used in this connection as an annular clip bead, for which purpose the corresponding zone of the inner edge of the push piece cup has an annular shoulder 18' with a funnel-like run-on surface in front of it. The required yielding movement of the wall of the cup is obtained here from the flexibility of the plastic material used on the one hand and, on the other hand, by the fact that the wall of the cup has a recess 42 which extends to beyond the outer wide side of the middle piece 1 and terminates closely in front of the bottom of the cup. The length of the recess 42 permits the application of a tool which raises or unclips the push piece 18 out of the guide shaft 19 (for instance a screw driver, hair barrette etc.). The width of the recess 42 is so dimensioned that only the battery rim 34 comes into contact with the terminal 35 of the bulb 36 upon actuation of the push piece.

Figure 11:
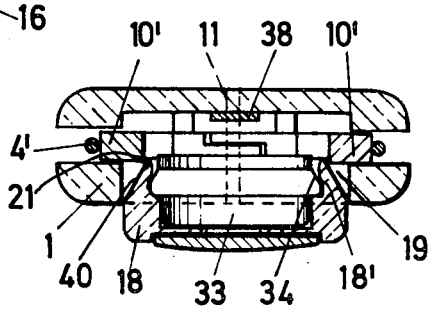
FIG. 11 is a section along the line XI—XI of FIG. 9.

The spreading movement of the tongs is based on the control surfaces 40 which are arranged on the circumference of the cup-shaped push piece 18 and correspond to the conical surface described above, the control surfaces 40 cooperating with control edges 21 of the actuating arms 10 (see FIG. 11). The return spring, which effects the closing of the tong jaws 2, is developed here in the form of a spring clip 4' of approximately U shape which surrounds the mounting-side end (pivot pin 11) and, via the control surfaces 40, pushes the push piece 18 into its basic position. The spring clip 4' is arranged in an edge notch of the middle piece on the side of the eye. The ends of its legs are bent inward and enter into a recess on the outer surface of the actuating arms 10'.

The push piece 18 is fastened by means of a clip mount by the cup edge being provided on its outer wall with clip projections 43 lying diametrically opposite each other. These projections lie in the longitudinal axis x—x and engage behind an edge 19'—undercut somewhat for this purpose—of the guide shaft 19 which is closed on the bottom. The backs of the projections are developed as run-on bevels which converge in the inward direction of the shaft.

The control surfaces 40 of the push piece 18 lie in the same plane as the tong-jaw actuating arms 10' and their control surfaces 21. The control surfaces 40 extend in the transverse direction, i.e. perpendicular to the longitudinal axis x—x. The pivot-side ends of the actuating arms 10' are proportionally stepped-down so that a bend in the region of the tong jaws 2 (FIG. 2) can also be dispensed with. The shape is thereby made flatter.

Each of the embodiments described can be further developed with respect to its mouth M in the manner shown in FIGS. 12 to 16. This further development resides in the fact that the opening-side end sections 2'' of the jaws 2 which surround the mouth M form, on the inner side of the mouth, a linearly extending resting edge K for the keyhole 5. This resting edge extends transversely to the pulling force which occurs and in the plane of swing of the actuating arms 10'. This avoids any tendency to separate in case of excessive load.

Figure 12:
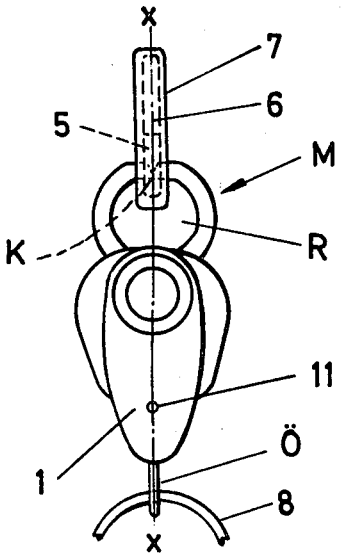
FIG. 12 is a further development of the coupling member with reference to a particular development of its mouth, seen in front view.
Figure 13:
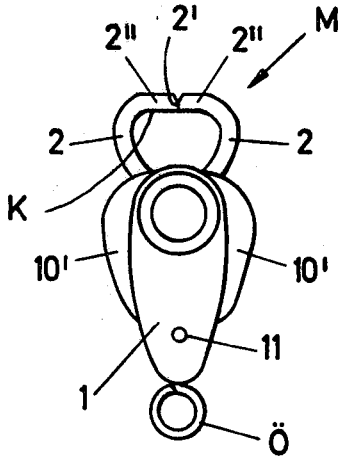
FIG. 13 is a corresponding view with a slight modification of the mouth part.

This flattening, which lies on the inside of the opening, can, as shown in FIG. 12, extend over a relatively short region or else—as shown in FIG. 13—extend practically over the entire width of the inside R of the mouth.

Figure 16:
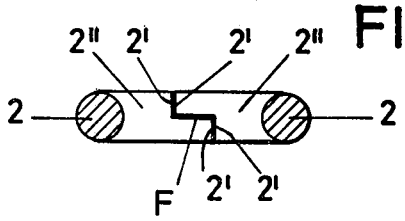
FIG. 16 is a cross section along the line XVI—XVI of FIG. 14.
Figure 14:
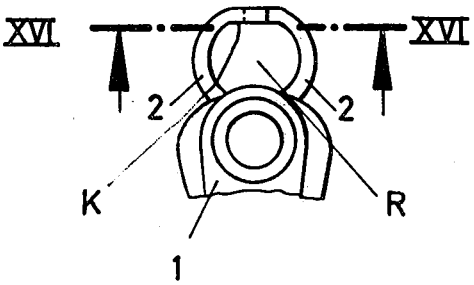
FIG. 14 is an additional embodiment with the coupling member shown only in part.
Figure 15:
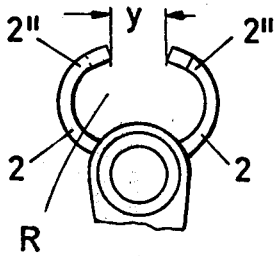
FIG. 15 shows this coupling member with mouth open.

In FIGS. 14 to 16 this measure has been included, only that the end sections 2'' of the jaws 2 in this case overlap each other in practically a claw-like manner in the form of a Z joint F. The central section of the Z joint F extends in the plane of the mouth while the shorter joint sections, forming here practically stepped jaw end surfaces 2', extend in opposite directions transversely to the plane of the opening. These sections are perpendicular to the middle section. The stepping, despite the overlapping engagement of the end parts, serves to maintain the circular overall cross section of the jaws 2 in this region.

I claim:

1. In a coupling member for attachment of a key ring, provided with an eye or the like arranged in the vicinity of one end for the attachment of a key ring, and having at an opposite end a mouth formed by two tong jaws which jaws come together in tong-like fashion and which jaws project out beyond a housing-like middle piece, the mouth having an interior space and defining an opening cross-section, the opening cross-section, the interior space of the mouth and the eye being arranged one behind the other on a longitudinal axis of the middle piece, the improvement comprising one common pivot pin mounted in said middle piece, both of said tong jaws are pivotally mounted on said one common pivot pin, return spring means for spring-biasing said jaws into a closing position thereof, means comprising actuating surfaces which are mounted between said eye and said mouth and pressably-in transversely to said longitudinal axis of the middle piece for displacing said jaws in an opening direction against said spring-biasing.

2. The coupling member according to claim 1, wherein the longitudinal axis constitutes an axis of symmetry of said coupling member.

3. The coupling member according to claim 1, wherein said jaws are mounted to move in a plane of movement and are each formed with a one-piece actuating arm, the latter constituting one of said actuating surfaces, respectively, a push piece means, the latter constituting another of said actuating surfaces, for actuating at least one of said actuating arms, means defining a guide shaft for mounting said push piece means therein displaceably transversely to said plane of movement between said arms.

4. The coupling member according to claim 3, wherein said middle piece constitutes said means defining said guide shaft, said jaws are formed with said actuating arms mounted in said middle piece, two of said push piece means open at both wide sides of the middle piece and are moveably actuatable in a direction opposite each other in said guide shaft, said push piece means have a conical shape on inner sides thereof, said actuating arms each have a widened portion and are formed thereat with a hole having control edges, said conical shape of said push piece means operatively engages said control edges.

5. The coupling member according to claim 4, wherein said return spring means are disposed in the plane of movement of said jaws and said return spring means are disposed in said actuating arms in regions thereof laterally relative to said holes, respectively.

6. The coupling member according to claim 3, wherein said middle piece constitutes said means defining said guide shaft, a button battery having a rim, a bulb is disposed in said middle piece at said opposite end aligned with said axis facing said opening cross-section of the mouth and disposed in the plane of movement of said jaws, said bulb has one terminal facing away from said mouth, said push piece means is formed with a wall defining a cup and forming a recess communicating with an interior of said cup extending over a pressing-in depth of the push piece means in said guide shaft, said button battery is disposed in the interior of said cup, said rim of said battery extends into said recess and in a pressed-in position of said push piece means in said guide shaft engages said one terminal of said bulb.

7. The coupling member according to claim 6, wherein said actuating arms are pivotally mounted at one end thereof at a pivot point in said middle piece defined by said pivot pin, said return spring means for biasing said jaws into said closing position thereof comprises a U-shaped spring clip which surrounds said one end of said actuating arms, said actuating arms of said jaws are partially stepped-down in a region of said pivot point.

8. The coupling member according to claim 6, wherein said push piece means defines said cup and clamps said button battery in said interior of said cup in a clamp fit, said wall of said push piece means constitutes an outer cup wall forming at opposite sections thereof control surfaces, said actuating arms engage said control surfaces.

said guide shaft is formed with an edge, said push piece means is formed with an edge of the cup having clip projections which engage inwardly behind said edge of said guide shaft, said edges constitute means for limiting outward movement of said push piece means caused by said actuating arms biased by said return spring means.

9. The coupling member according to claim 1, 7, or 6, wherein said jaws circumscribe said mouth and each have abutting opening-side end sections, respectively, said end sections define said opening cross-section therebetween when said jaws are in an open position, said end sections on the interior of the mouth form a linearly extending rest edge adapted for a hole portion of a key to rest thereon.

10. The coupling member according to claim 9, wherein said end sections of said jaws engage over one other forming a Z joint.

* * * * *

UNITED STATES PATENT AND TRADEMARK OFFICE

CERTIFICATE OF CORRECTION

PATENT NO. : 4,376,383

DATED : March 15, 1983

INVENTOR(S) : Heinz Wolter

It is certified that error appears in the above-identified patent and that said Letters Patent are hereby corrected as shown below:

Column 8 Line 48 (Claim 9) "7" should read --3--

Signed and Sealed this

*Twenty-first* Day of *June 1983*

[SEAL]

*Attest:*

DONALD J. QUIGG

*Attesting Officer*

*Acting Commissioner of Patents and Trademarks*